US010570623B1

(12) United States Patent
Wells et al.

(10) Patent No.: US 10,570,623 B1
(45) Date of Patent: Feb. 25, 2020

(54) APPARATUS AND METHOD FOR TEMPORARILY ALLOWING USE OF AND PROTECTING A STAIRWAY FRAMEWORK DURING CONSTRUCTION OF BUILDINGS

(71) Applicant: Protex Products, LLC, Chicago, IL (US)

(72) Inventors: Brad Wells, Bloomfield Hills, MI (US); William A. Depel, Crown Point, IN (US)

(73) Assignee: Protex Products LLC, Chicago, IL (US)

( * ) Notice: Subject to any disclaimer, the term of this patent is extended or adjusted under 35 U.S.C. 154(b) by 0 days.

(21) Appl. No.: 16/054,352

(22) Filed: Aug. 3, 2018

(51) Int. Cl.

| | |
|---|---|
| ***E04F 11/17*** | (2006.01) |
| ***E04F 11/16*** | (2006.01) |
| ***E04F 11/104*** | (2006.01) |
| ***E04G 21/30*** | (2006.01) |

(52) U.S. Cl.
CPC ..... *E04F 11/17* (2013.01); *E04F 11/1045* (2013.01); *E04F 11/163* (2013.01); *E04G 21/30* (2013.01)

(58) Field of Classification Search
CPC ..... E04F 11/17; E04F 11/163; E04F 11/1045; E04G 21/30
See application file for complete search history.

(56) References Cited

U.S. PATENT DOCUMENTS

| | | | | |
|---|---|---|---|---|
| 1,113,355 | A * | 10/1914 | Kent | E04F 11/163 152/209.1 |
| 4,285,177 | A * | 8/1981 | Seegers | E04F 11/025 428/688 |
| 9,945,137 | B2 * | 4/2018 | Prest | E04G 21/30 |
| 2008/0254253 | A1 * | 10/2008 | Gallager | A47G 27/0287 428/86 |

* cited by examiner

*Primary Examiner* — Patrick J Maestri
(74) *Attorney, Agent, or Firm* — Rockman Videbeck & O'Connor

(57) ABSTRACT

A temporary tread insert and method for installation in a stairway framework during building construction. The temporary tread insert includes an insert body having an upper tread surface, a bottom surface and opposed side surfaces. A front end of the insert body has a substantially bullnose shaped curved surface. The upper tread surface has a notched surface extending along the upper tread surface. Also disclosed is the method of inserting the temporary tread insert into the stair pan of a stairway framework, where the stair pan includes a bullnose at a front end of the stair pan, and the bullnose has a portion extending laterally a distance into the stair pan. The temporary tread insert includes a notched surface. The method includes positioning the temporary tread insert above a bottom of the pan, inserting the notched end of the temporary tread insert beneath the laterally extending portion of the bullnose, and moving the rear end of the temporary tread insert downward until the notched end of the temporary tread insert engages the underside of the portion extending laterally from the bullnose.

9 Claims, 9 Drawing Sheets

APPARATUS AND METHOD FOR TEMPORARILY ALLOWING USE OF AND PROTECTING A STAIRWAY FRAMEWORK DURING CONSTRUCTION OF BUILDINGS

BACKGROUND OF THE INVENTION

Field of the Invention

The present invention pertains to an apparatus and method for temporarily allowing the use of and protecting the stair pans of a metal stairway framework or skeleton installed in a building during the early stages of construction and prior to forming the finished stair tread by filling the stair pan with concrete. More specifically, the present invention provides a temporary tread insert to be placed into the stair pan of a metal stairway structure where the stairway structure is installed in a building during construction, and the method of installing and removing the temporary tread insert from a stair pan.

Description of the Prior Art

During the construction of a building, both commercial and residential, a metal stairway framework is installed in the building upon completion, or near completion, of the ground or basement floor foundation, and is continuously installed as each floor to the building is then constructed. The stair framework is normally hung from the steel or concrete superstructure of the building. The stair framework is used by the construction workers to access and egress the upper floors during construction. Use of the stair framework may be in addition to a temporary external elevator system operating at the worksite.

The typical metal stair framework that is ultimately filled with concrete includes a four-sided stair pan where each of the tread portions of the stair will later be installed as construction of the building advances upward. The stair pan height normally ranges between one and one-half to two inches, depending on building codes, architectural design and the manufacturer of the stairway framework. The stair pan is also approximately 12 inches in depth per code and other requirements. In certain construction processes, concrete, cement, or an equivalent material, is poured into the stair pan to form the final tread of the stairs. The typical stair pan structure of a metal stairway framework includes a bullnose feature at the front end of the stair tread, with an upper lip extending rearwardly a short distance of between five eighths to one and one half inches typically towards the riser portion of the metal stairway framework located at the rear of each stair pan. The bullnose structure is a requirement of most, if not all, building codes. The radius of the bullnose may differ from one stairway framework manufacturer to another, or between architects. In addition, the thickness of the metal comprising the stair pan and the bullnose feature may vary from manufacturer to manufacturer. The width of the tread portion of the metal stairway may also vary from building to building.

OSHA requirements set forth rules applicable to stairways used temporarily during construction. Some of these rules require that temporary treads must be replaced when worn below the top edge of the stair pan, and that temporary treads must be installed the full width and depth of the stair pan. In addition ANSI standards require that all finished stair treads and nosing be made of a slip resistant material. This requirement is satisfied by the presently disclosed temporary tread insert.

Further, OSHA Standard 1910.144(a)(3) and ANSI Standard Z535.1-2017 designate yellow as the safety color code indicating "caution," and for marking physical hazards such as striking against, stumbling, falling, tripping and caught in between. The presently disclosed temporary tread insert includes a surface adapted to be covered by a yellow caution strip adjacent the bullnose of the stair pan. The presently disclosed temporary tread insert also meets the requirements of NFPA Life Safety Codes related to exit stair treads and manufactured from fire rated recycled material.

Presently, contractors typically insert wood strips about one and one half to two inches thick and twelve inches deep into the pan of the metal stairway structure during construction to provide a temporary tread for a construction worker to step on while using the stairway, in an effort to meet OSHA and other building code requirements. Also, chopped insulation board and Styrofoam have been known to be used for this purpose. The wooden strips are also inserted into the stair pan to prevent construction debris from collecting in the stair pan. However, these wood treads are not an efficient or practical solution to the problem. Normally the wooden or chopped insulation board does not cover the entire stair pan area, and is not flush with the bullnose as required by OSHA building codes. For example, a 2 inch by 12 inch piece of wood is actually 1.5 inches high and 11¼ inches deep, yet many, if not most, stair pans are 2 inches high and 12 inches deep. In addition, a 2 inch by 12 inch piece of wood does not necessarily fill the full cross dimension of the stair pan. The risers, by code, are offset by 1 inch so the riser bullnose walls are not vertical. Thus, the wood treads, which are normally square, do not fit property either. Also, debris from the construction process gets into the spaces between the pan and the temporary tread, requiring an extensive clean out of such debris when the temporary wooden treads are removed to allow the final concrete tread to be poured into the pan. Additionally, the wood temporary treads are not slip resistant and have a tendency to wear out, warp, and/or crack over time during construction as workers go up and down the stairway, sometimes dragging or rolling heavy loads over the temporary wood treads. Wood temporary treads are also a fire hazard, and normally do not have safety stripes to help prevent trips or injuries.

In addition, certain stairway structures have a stair pan width greater than the length of a piece of wood, leaving a gap in the stair pan, and a second piece of wood may be required to provide a temporary tread across the entire width of the pan. Besides requiring that the second piece of wood must be cut or located to fill this gap, the space between the two wood treads provides another large space in which construction debris can collect. This also creates a major fire hazard from between the wood cracks.

U.S. Pat. No. 9,091,073 discloses specifically constructed temporary floor and stair protective covers to provide temporary stair damage protection while construction, repair, or relocation work is taking place in a facility that includes a finished stair structure. The '073 disclosure is applicable to protect finished stair treads, while the presently disclosed device is actually a tread itself, used prior to the installation of the finished stair tread. In the apparatus shown in the '073 patent, the disclosed protection board is made or cut into pieces that fit over the finished stair treads and risers, and the protective material is adhesively attached to the existing stair tread and/or riser. A separate outer bullnose surface guard is pivotally attached to the protection board, enabling the guard to bend over the outer surface of the bullnose so the guard can be connected to the adjacent riser and tread portions of the protective cover.

The device disclosed in the '073 patent does not address or solve the problem to which the presently disclosed apparatus and method is directed towards solving. The present device and method is directed to the structure and installation method of a temporary tread insert used in the stair pan of a metal stairway structure, where the stairway structure includes a stair pan in which a final stair tread is subsequently installed. The temporary tread insert fits into the stair pan and beneath the bullnose of the stairway frame, and not over an existing permanent tread or over a permanent and existing bullnose. The device disclosed in the '073 patent is not designed or constructed to fit into the stair pan of a typical metal stairway framework that has no permanent or finished tread or bullnose structure. The presently disclosed apparatus and method are directed to providing support to workers involved in the early stages of building construction, and not protecting finished stairs during remodeling after the final stairway has been completed with a finished surface.

SUMMARY OF THE INVENTION

The present disclosure describes a temporary tread insert for installation in a stair pan of a stairway framework during building construction. The temporary tread insert includes an insert body having an upper tread surface, a bottom surface and opposed side surfaces. A front end of the insert body has a substantially bullnose shaped curved surface. The upper tread surface has a notched surface extending along the upper tread surface. Also disclosed is the method of inserting the temporary tread insert into the stair pan of a stairway framework where the stair pan includes a bullnose at a front end of the stair pan, and the bullnose has a portion extending laterally a distance into the stair pan. The temporary tread insert includes a notched surface. The method includes positioning the tread insert above a bottom of the stair pan, inserting the notched end of the temporary tread insert beneath the laterally extending portion of the bullnose, and moving the rear end of the temporary tread insert downward until the notched end of the tread insert engages the underside of the portion extending laterally from the bullnose.

DETAILED DESCRIPTION OF THE ILLUSTRATED EMBODIMENT

Figure 1:
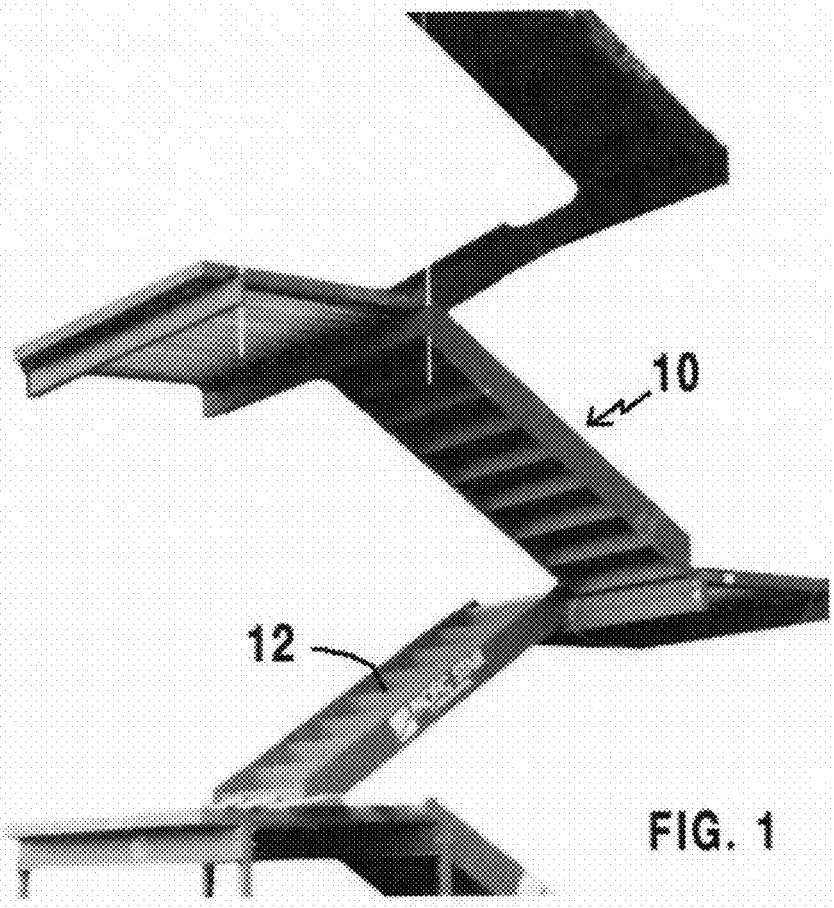
FIG. 1 is a perspective view of a typical metal stairway skeleton or framework installed in a building during the early stages of building construction.
Figure 2:
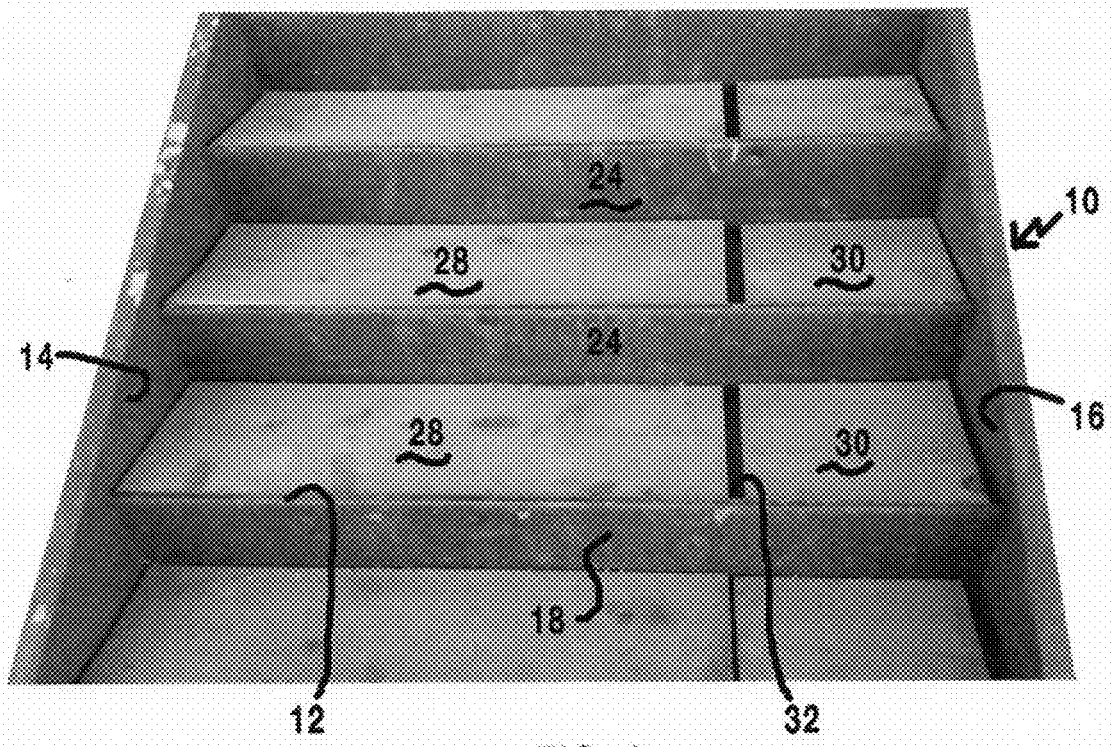
FIG. 2 is a front perspective view of a metal stairway framework including two wooden temporary tread portions in several of the stair pans of the framework to allow construction workers to use the stairway framework during construction.
Figure 7:
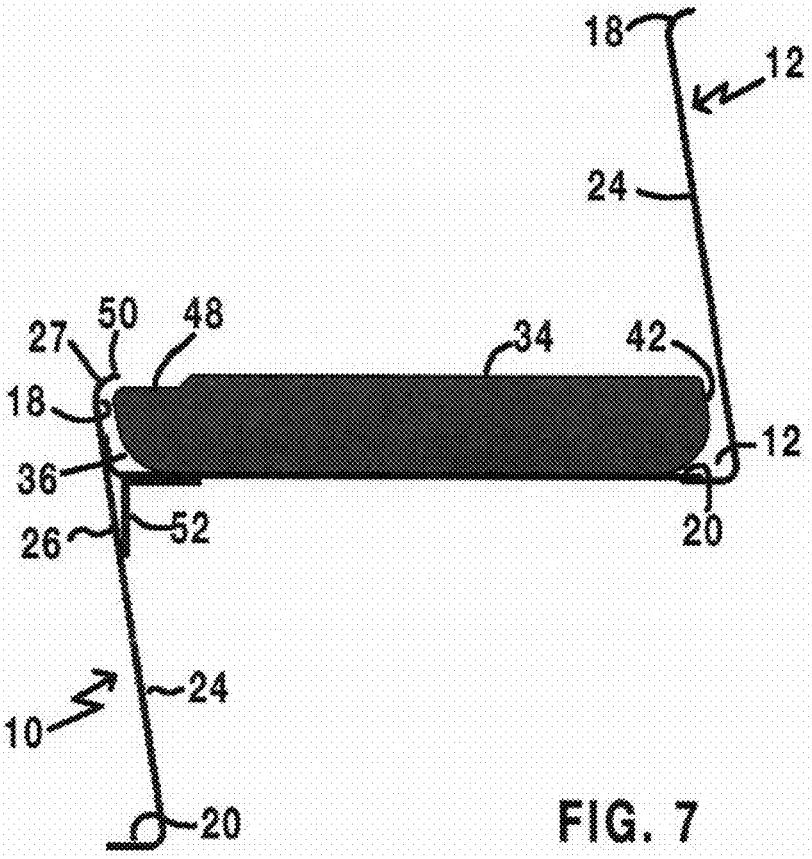
FIG. 7 is a side schematic view of a temporary tread insert installed in a stairway framework having a first bullnose configuration.
Figure 8:
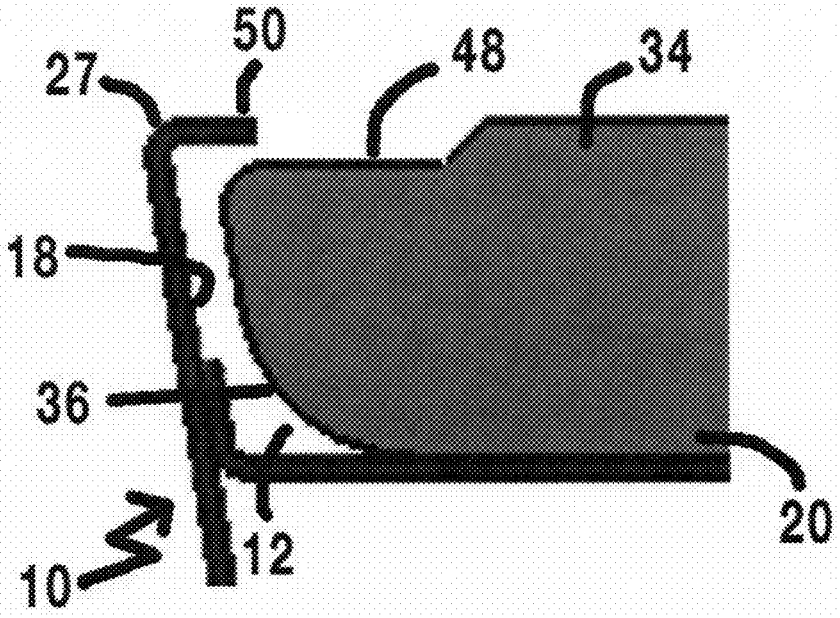
FIG. 8 is a side schematic detail view of the front of the temporary tread insert installed in a stairway framework having a second bullnose configuration.
Figure 9:
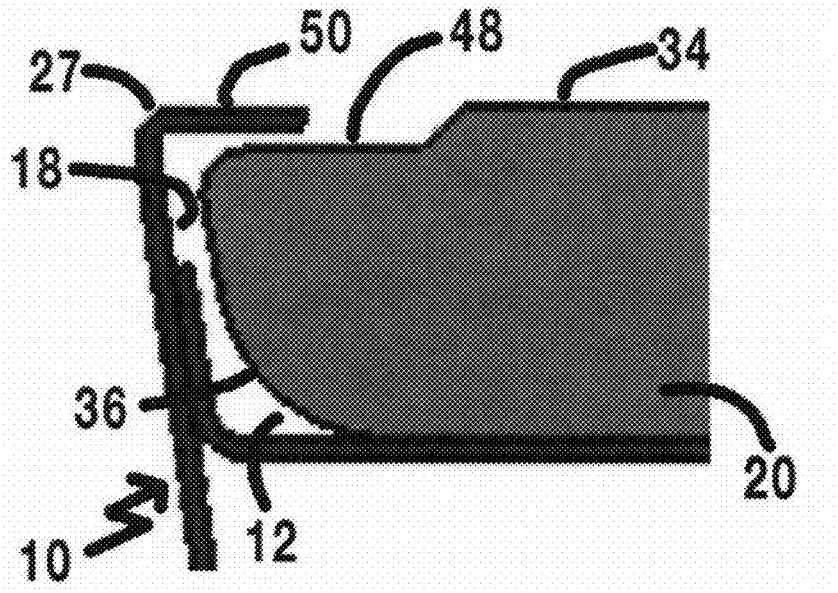
FIG. 9 is a side schematic detail view of the front of the temporary tread insert installed in a stairway framework having a third bullnose configuration.
Figure 10:
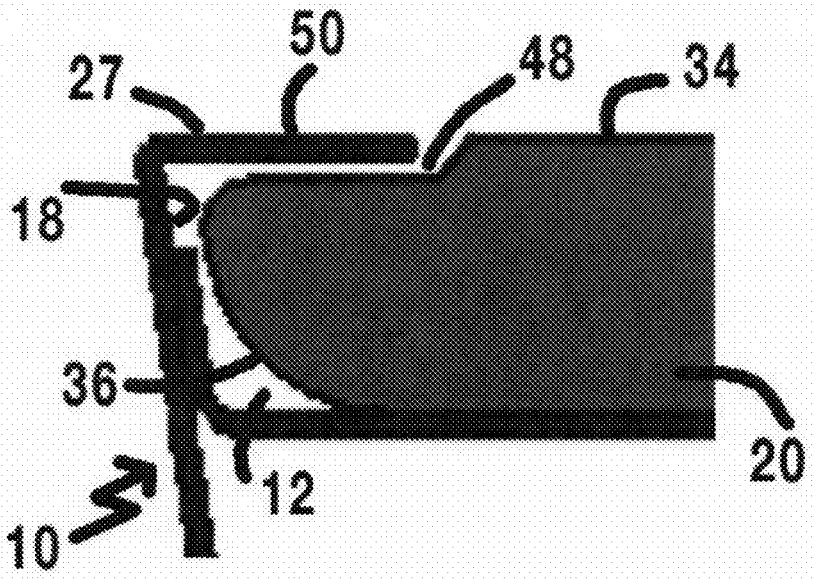
FIG. 10 is a side schematic view of the front of the temporary tread insert installed in a stairway framework having a fourth bullnose configuration.
Figure 11:
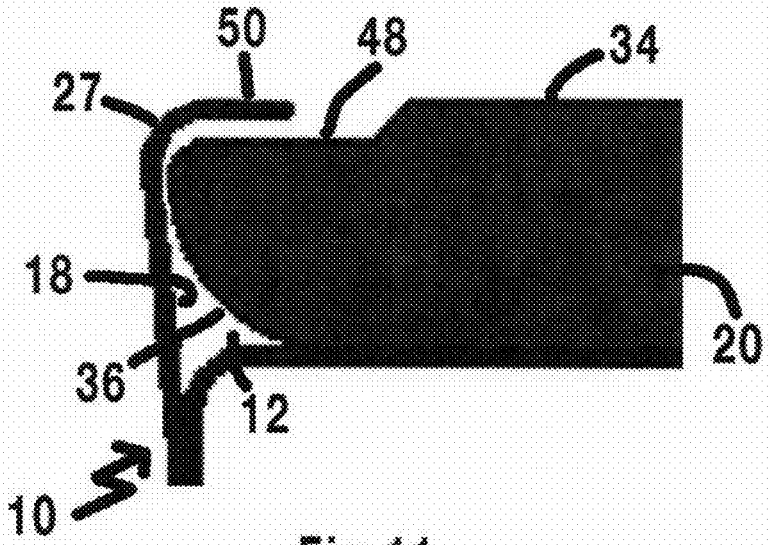
FIG. 11 is a side schematic detail view of the front of the temporary tread insert installed in a stairway framework having a fifth bullnose configuration.
Figure 12:
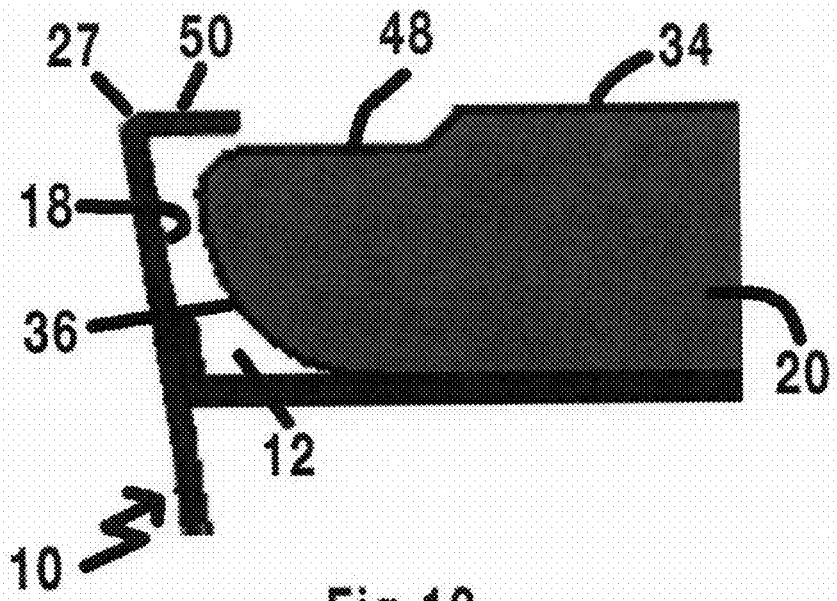
FIG. 12 is a side schematic detail view of the front of the temporary tread insert installed in a stairway framework having a sixth bullnose configuration.

Referring to FIGS. 1 and 2, a metal building stairway framework or stairway skeleton 10 is shown installed on the bottom floor of a building under construction. During construction, debris normally falls onto and covers all or most all horizontal surfaces of the construction site. Among these horizontal surfaces are stair pans 12 formed in stairway framework 10, shown more clearly in FIGS. 7-15, which pans 12 ultimately receive concrete or other suitable material to form final stair treads and risers toward the end of the construction process. As shown in FIGS. 2 and 7, each stair pan 12 has opposed sidewalls 14, 16 and a front wall 18. The bottom of each stair pan 12 comprises a solid surface 20 (FIGS. 7-15), which bottom surface is adapted to receive and support a temporary tread insert 22, as will be explained. The rear of each stair pan 12 is formed by riser surface 24, where the upper extent 26 of each riser surface forms the front wall 18 of each succeeding stair pan 12, as shown in FIG. 7.

It is apparent that stair pans 12 per se are not suitable to support a construction worker while ascending and descending stairway framework 10. The worker's feet would stumble over the walls of the stair pans were not a filler material inserted into each stair pan to provide an upper surface substantially the same height as bullnose 27 on the upper extent 26 of each riser 24 and the front of each stair pan 12. As shown in FIG. 2, a presently used common temporary wooden tread 28 is inserted into each stair pan 12. As also seen in FIG. 2, if the crosswise length of each wooden tread is not sufficient to extend laterally across the stair pan 12, an additional wooden strip 30 must be inserted to fill the remaining lateral space. This leaves undesirable gaps 32 in which debris could be collected in the stair pan, and the wooden tread is not held in place by any member of the stairway framework 10.

Figure 3:
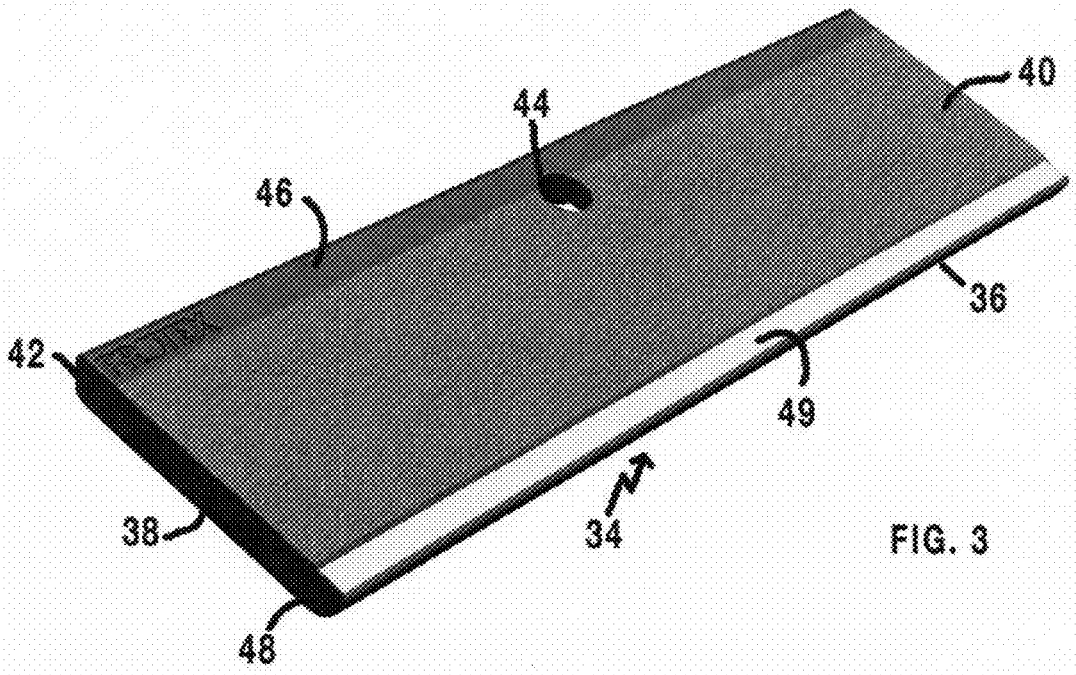
FIG. 3 is a top perspective view of an embodiment of the temporary tread insert of the present disclosure with a non-slip surface covering substantially the full temporary tread insert upper surface.
Figure 4:
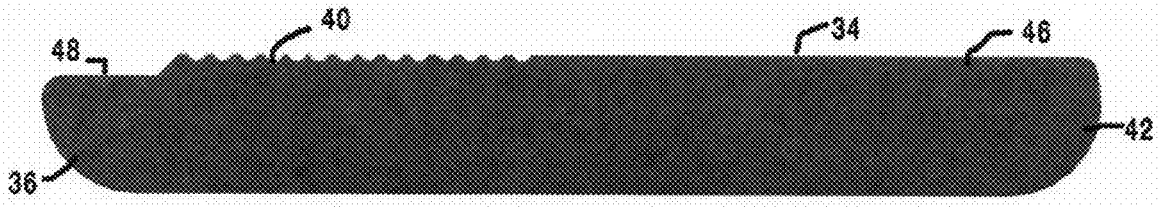
FIG. 4 is a cross-section view of an embodiment of the temporary tread insert of FIG. 3, having a first thickness dimension, and a non-skid surface extending partially along the width of the temporary tread upper surface.
Figure 5:
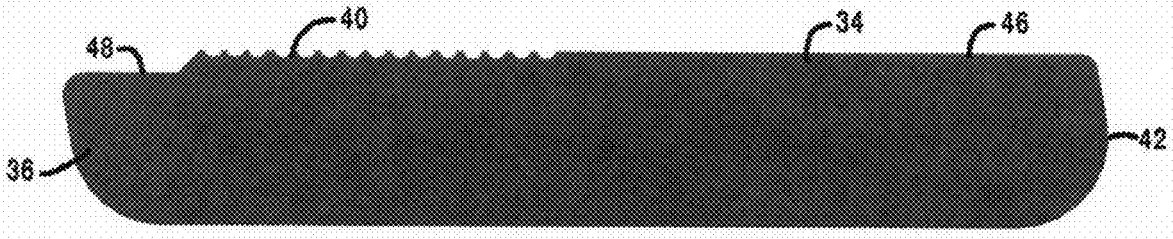
FIG. 5 is a cross-section view of the embodiment of the temporary tread insert of FIG. 4, although having a second thickness dimension.

FIG. 3 shows an embodiment of a temporary tread insert 34 in accordance with the teachings of the present disclosure, having an insert body with a front curved or bullnose surface 36, and flat side surfaces 38 on either side. A non-skid surface 40 is applied to the upper surface of tread insert 34, which in the embodiment of FIG. 3 extends from front surface 36 to substantially the rear end 42 of the tread insert. In other embodiments of the tread insert, the non-skid surface 40 may be applied to only a forward portion of temporary tread insert 34, as illustrated in the embodiment of FIGS. 4 and 5. Temporary tread insert 34 also includes an aperture 44 to allow engagement by a user's finger or other instrumentality for removal of the tread insert from a stair pan 12, as will be explained. The upper surface of temporary tread insert 34 may also include a smooth portion 46 adapted to locate a trademark, company name or other identifying symbol of the entity supplying the tread insert 34 to the construction site. A notched or indented surface 48 extends across the front top surface of temporary tread insert 34 for purposes to be explained. A yellow safety or warning tape or paint stripe 49 may be applied over notched surface 48, as required by applicable safety codes and standards.

Stairway frameworks 10 are usually furnished with stair pans 12 either 1.5 or 2 inches deep. FIG. 4 is a cross section profile of temporary tread insert 34 for a 1.5 inch deep pan 12, and FIG. 5 illustrates the cross-section profile of a temporary tread insert 34 for a 2 inch deep pan 12. In the embodiments shown in FIGS. 4 and 5, non-skid surface 40 extends only partially across the upper surface of temporary tread insert 34.

Figure 6:
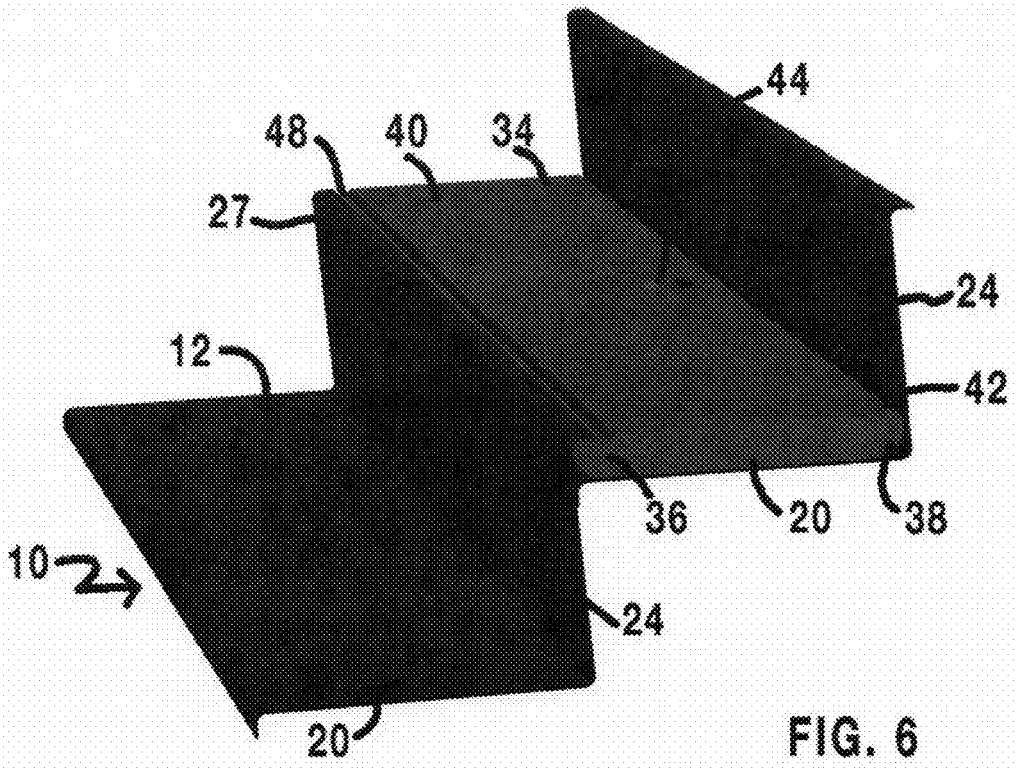
FIG. 6 is a perspective cross-section view of the temporary tread insert of FIG. 3 fully inserted into a stairway pan.

FIG. 6 illustrates a temporary tread insert 34 fully inserted into a stair pan 20 of stairway framework 10. Notched surface 48 of front curved surface 36 extends beneath and is firmly engaged by bullnose 27 of stairway framework 10. FIG. 6 also illustrates an empty lower stair pan 12 that is ready to receive a temporary tread insert 34 in the same manner as the stair pan 12 just above the empty pan. Aperture 44 allows easy insertion and removal of temporary tread insert 34 into and out of pan 12.

At present, there are several different manufacturers of stairway frameworks of the general type illustrated in FIG. 1. Applicant's present temporary tread insert 34 is adapted to fit into the stair pans 12 of many, if not all of those different stairway frameworks. FIG. 7 illustrates how the present temporary tread insert 34 fits into a first stairway framework during building construction and before the tread insert is removed and concrete or other material is installed in each stair pan 12 to create a final staircase tread.

As seen in FIG. 7, the top of stair pan front wall 18 includes a bullnose 27, having a laterally extending portion 50, and a bracket 52 firmly attached to riser surface 24, such that the bottom 20 of stair pan 12 is supported by bracket 52. The rear 54 of stair pan 12 is supported by a laterally extending flange 56 of the next succeeding riser 24' (FIG. 7). Typical stair pans may or may not have brackets as each is designed a little differently depending on manufacturer and architectural drawings. However, all stair pans are either welded, bolted or riveted together, or a combination of each support structure based on codes, architects or other requirements. When temporary tread insert 34 is inserted into stair pan 12, lateral portion 50 of bullnose 27 extends over and engages notched portion 48 of the tread insert, thus holding the front curved surface 36 of tread insert snugly in stair pan 12 between pan bottom 20 and lateral bullnose portion 50. A small gap 56 is disposed between rear end 42 of the tread insert 34 and riser surface 24' to allow ease of insertion and removal of temporary tread insert relative to pan 12.

FIGS. 8 through 12 are detail illustrations of several extant stairway framework structures 10 with different bullnose 27 configurations, illustrating how the front curved surface 36 and notched surface 40 of temporary tread insert 34 engages and fits beneath each differently configured lateral portion 50 of each bullnose 27. Element numbers in FIG. 7 are used to identify corresponding elements in FIGS. 8-12.

Temporary tread insert 34 can be manufactured using several production processes. For example, extrusion is a high volume manufacturing process in which raw plastic is melted and formed into a continuous profile of the selected temporary tread insert 34. This process starts by feeding plastic material (pellets, granules, flakes or powders) from a hopper into the barrel of an extruder. The material is gradually melted by the mechanical energy generated by turning screws and by heaters arranged along the barrel. The molten polymer is then forced into a die conforming to the shape of the tread insert.

A second method is compression molding, in which the molding material, generally preheated, is first placed in an open, heated mold cavity. The mold is closed with a top force or plug member, and pressure is applied to force the material into contact with all mold areas while heat and pressure are maintained until the molding material has cured. Advanced composite thermoplastics can also be compression molded.

A third method is injection molding, which comprises injecting molten material into a mold under pressure. Injection molding can be performed using several materials, but most commonly thermoplastic and thermosetting polymers. Material for the tread insert is fed into a heated barrel, mixed and injected under pressure into a mold cavity where the material cools and hardens to the configuration and shape of the tread insert.

A fourth method is lamination, which comprises manufacturing a material in multiple layers so that the composite material achieves improved strength, stability, durability and other properties from the use of differing materials. A laminate is a permanently assembled object by heat, pressure, welding or adhesives.

A fifth method comprises various combinations of extrusion, injection and compression molding, sometimes referred to as hard tooling. The non-skid surface 40 can either be made as part of an injection or compression mold, or embossed onto the surface.

Tooling uses both soft tooling and hard tooling, and CNC machines.

The materials that can be used in the above-described manufacturing processes include carbon fiber reinforced plastic, thermoplastic, high density polyethylene, honeycomb, glass reinforced plastic, paper/cardboard, or sandwich structured composite.

Figure 18:
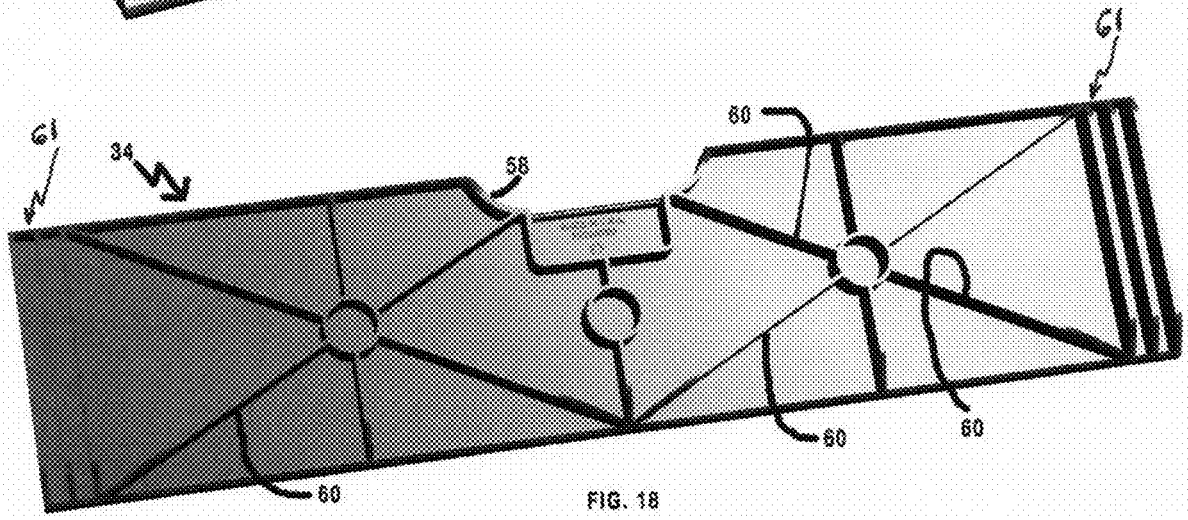
FIG. 18 is a bottom perspective view of another embodiment of the temporary tread insert having a ribbed strengthening underside structure.

As shown in FIG. 18, temporary tread insert 34 includes several ribbed sections 61 that enables a single injection or compression mold design to produce tread inserts 34 either one and one-half inches or two inches in height, and to produce tread inserts 34 of three different widths. Using one of injection or compression mold processes, a mold is made for the tallest and widest version of tread insert 34. Inserts (not shown) are physically placed in the mold to produce the shorter and narrower versions.

Figure 13:
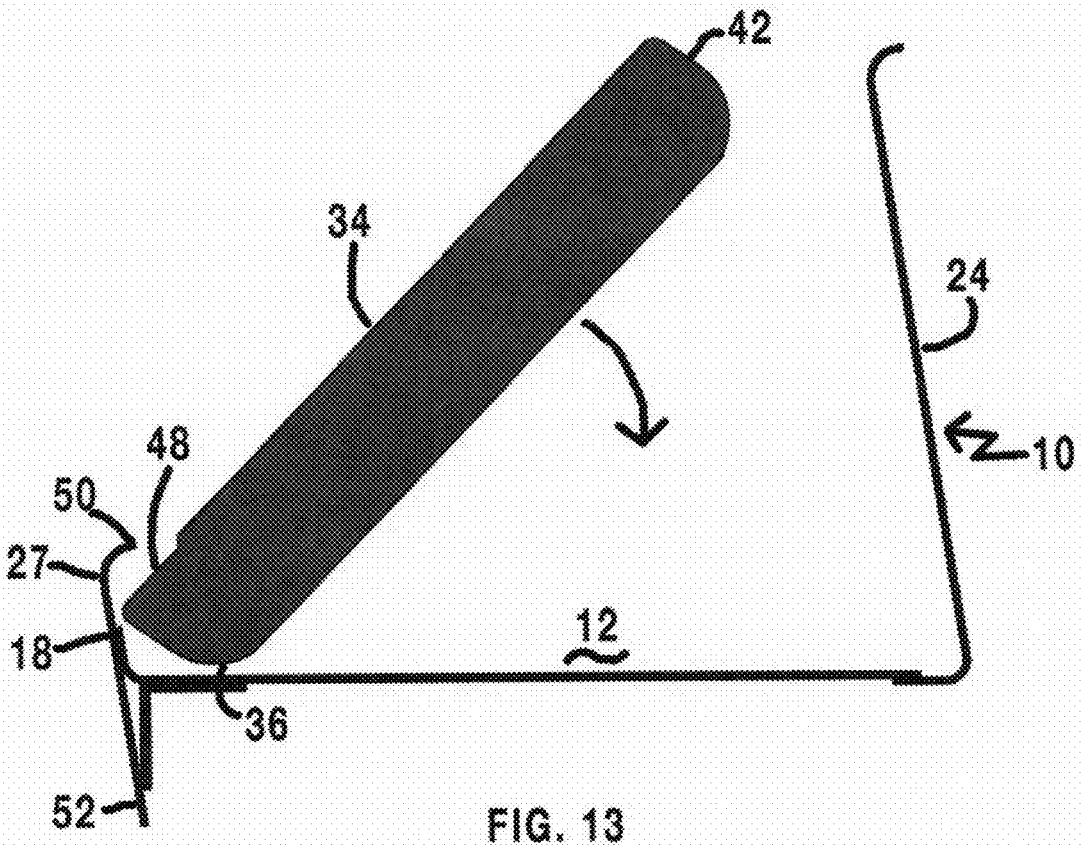
FIG. 13 is a side schematic view of the initial step of installing the temporary tread insert into the stair pan of a stairway framework.
Figure 14:
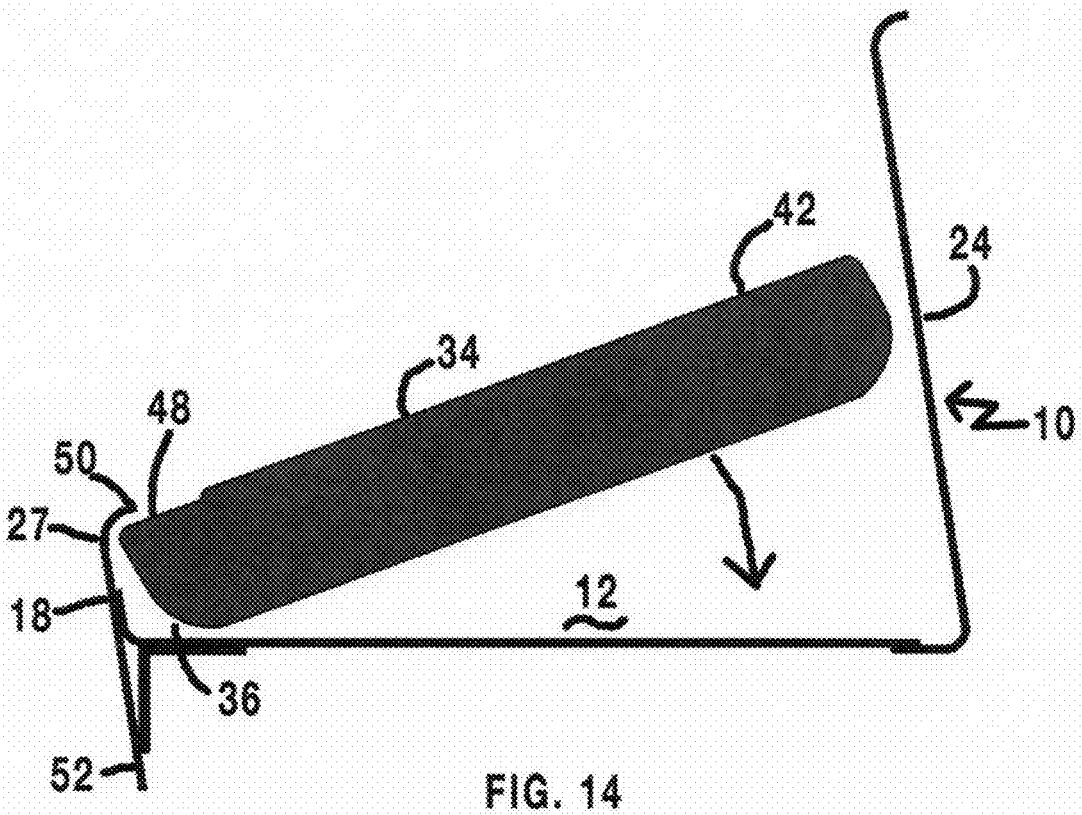
FIG. 14 is a side schematic view of an intermediate step in the installation of the temporary tread insert into the stair pan of a stairway framework.
Figure 15:
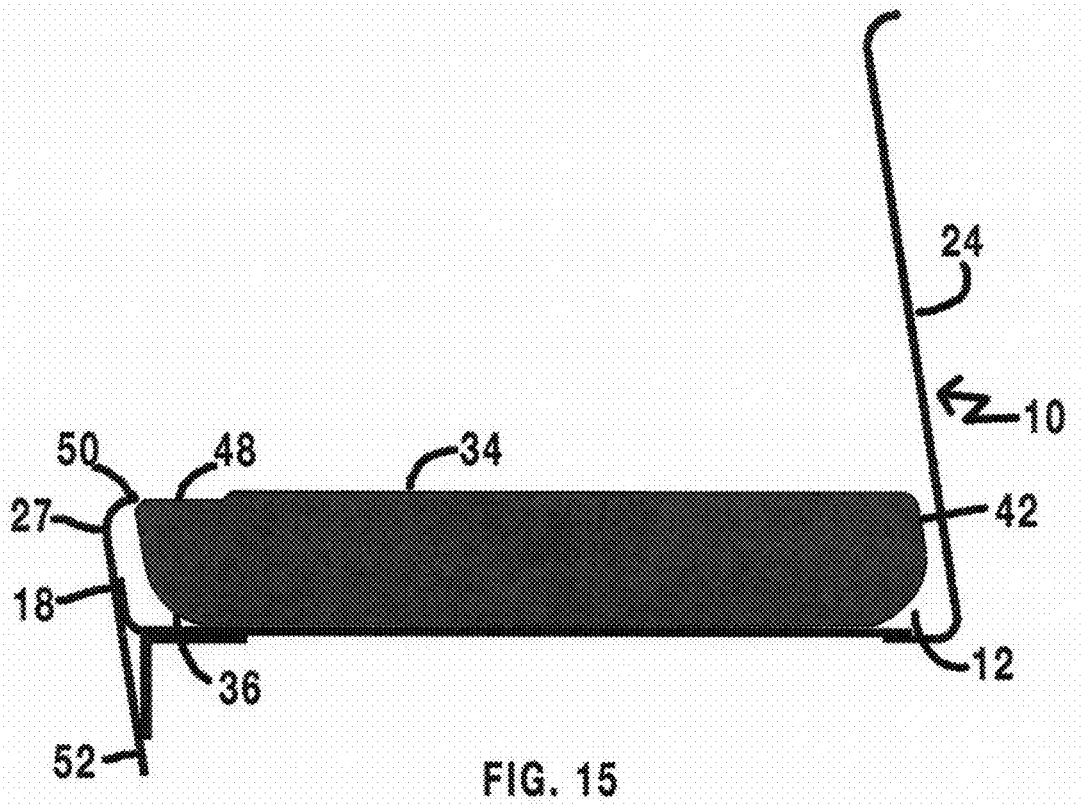
FIG. 15 is a side schematic view of the final step of installing the temporary tread insert into the stair pan of a stairway framework.

FIGS. 13-15 illustrate a method of installing a temporary tread insert 34 into a stair pan 12 of a stairway framework 10. As seen in FIG. 13, the tread insert 34 is held at an angle, and front curved surface 36 is inserted in stair pan 12 whereby notched surface 48 is located above bottom surface 20 of stair pan 12 and beneath lateral portion 50 of bullnose 27. Next, as shown in FIG. 14, the rear end 42 of temporary tread insert 34 is lowered such that the front curved surface 36 of the tread insert pivots against bottom 20 of stair pan 12, and notched surface 48 of tread insert 34 is advanced into contact with the underside of lateral portion 50 of bullnose 27.

Temporary tread insert 34 continues to be rotated downward in stair pan 12 (FIG. 14), until the tread insert is fully placed in stair pan 12, as shown in FIG. 15. When fully installed, the bottom surface of tread insert 34 rests on bottom 20 of stair pan 12, and notched surface 48 of the tread insert is firmly wedged against the lower surface of lateral portion 50 of bullnose 27, which wedging action secures tread insert 34 in stair pan 12 as downward forces are applied to the tread insert 34 upon construction workers ascending and descending the stairway framework 12.

At some point during the building construction process, the final stair materials are installed in stair pan 12 and along riser surface 24. This requires removal of each temporary tread insert 34 from its corresponding stair pan 12 before the permanent stair material can be installed. Referring to FIG. 3, an aperture 44 is located adjacent rear end 42 of tread insert 34, which aperture 44 in the illustrated embodiment extends through the thickness of tread insert 34. The aperture 44 can be other shapes, such as elongated, for example. To remove the tread insert 34 from stair pan 12, the worker uses aperture 44 to lift the rear end of the tread insert such that curved surface 36 and notched surface 48 are moved away from the underside of lateral portion 50 of bullnose 27, as shown in FIG. 13. Tread insert 34 can then be completely removed from its corresponding stair pan 12. Since the configuration of each temporary tread insert 34 has not been altered during its use in the construction process, each tread insert 34 can be reused on another construction project, or on upper tread pans of the same stairway framework.

Figure 16:
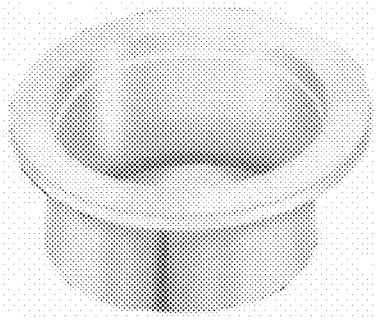
FIG. 16 is a perspective detail view of an embodiment of a removable plug inserted into an aperture of the temporary tread insert.

FIG. 16 illustrates a plug 56 for insertion into aperture 44 after the temporary tread insert 34 is positioned in stair pan 12. Plug 56 keeps construction debris from falling into stair pan 12 during the construction process. Configurations of plug 56 may vary, such as where the aperture 44 is other than circular.

Figure 17:
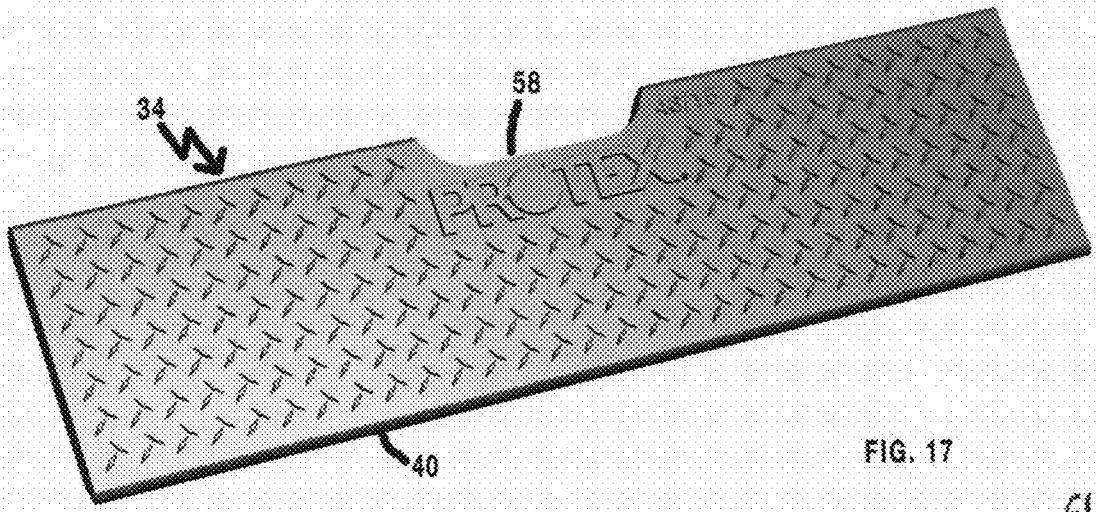
FIG. 17 is a top perspective view of another embodiment of the temporary tread insert having a recessed finger handle for removal of the insert from the stair pan of the stairway framework.

FIG. 17 illustrates an alternate embodiment of temporary tread insert 34, where aperture 44 (FIG. 3) has been replaced by an elongated cut-out portion 58 that allows a worker to use several fingers or another instrument such as a screwdriver or crowbar to remove the tread insert from stair pan 12, as described previously. In this embodiment, plug 56 (FIG. 16) is configured to be installed in and to cover cut-out portion 58. As stated previously, alternate cut-out aperture shapes can be used to facilitate the removal of tread insert 34 from stair pan 12. Also, FIG. 17 illustrates an alternate design of the non-skid surface 40 covering the entire upper surface of the tread insert.

FIG. 18 illustrates a further embodiment of temporary tread insert 34, where instead of comprising a solid material, the tread insert has a thinner upper surface, and uses cross-strut members 60 to provide vertical load strength to the tread insert. For example, the cross-strut members 60 of FIG. 18 are capable of withstanding a uniform load of 100 pounds per square foot, and a concentrated load of 300 pounds per square foot.

Figure 19:
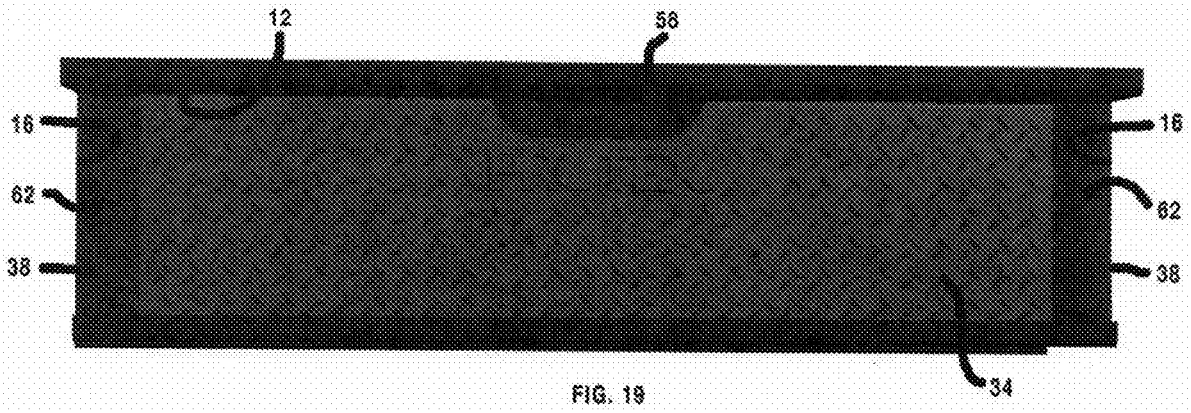
FIG. 19 is a top view of a temporary tread insert in the stair pan of a stairway framework, where the width of the temporary tread insert is shorter than the width of the stairwell pan and fungible trim plugs are inserted between the lateral ends of the tread insert and the upstanding sidewalls of the stair pan.
Figure 20:
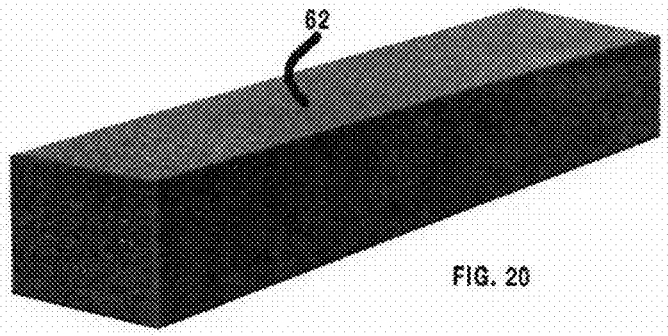
FIG. 20 is a perspective detail view of one of the fungible trim plugs of FIG. 19.

FIGS. 19 and 20 illustrate the use of the presently described temporary tread insert 34 in a stair pan 12, where the crosswise length of the stair pan is greater than the length of the tread insert. FIG. 19 illustrates a rectangular shaped foam plug 62 adapted to be inserted into stair pan 12 adjacent flat side surfaces 38 of temporary tread insert 34. When so placed, the fungible foam inserts 62 fill the spaces between each side surface 38 of the tread insert 34 in stair pan 12, and also prevent construction debris from depositing in stair pan 12.

Figure 21:
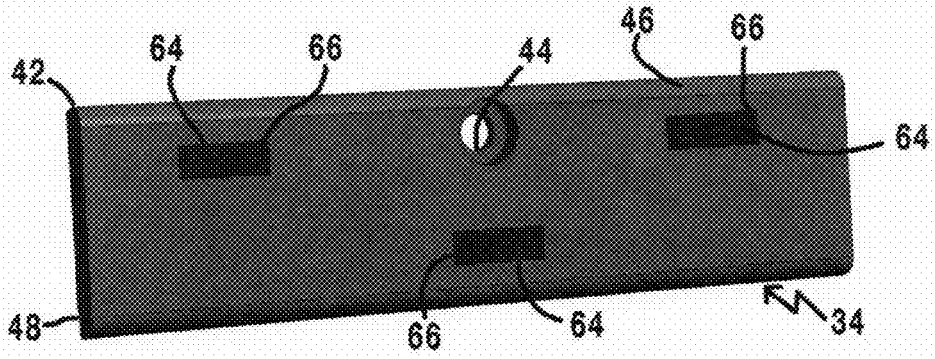
FIG. 21 is a perspective bottom view of an embodiment of a temporary tread insert having magnets located in recessed portions of the bottom surface of the insert.

FIG. 21 illustrates a further embodiment of the temporary tread insert 34 of the present disclosure, with a plurality of magnets 64 located in recessed portions 66 of the bottom surface of temporary tread insert 34. When fully inserted into a stair pan 12 of stairway framework 10, the magnets 64 will hold the tread insert 34 firmly to the metal bottom surface 20 of stair pan 12. The strength of magnets 64 is calibrated to allow the temporary tread insert 34 to be manually removed from stair pan 12 prior to the placement of concrete or cement into stair pan 12 to form the final stair tread. In yet another embodiment, the body of temporary tread insert 34 can be made of a magnetic material.

The above specification describes for the purpose of illustration, certain embodiments of a temporary tread insert, its use in stairway frameworks during building construction, and a method of installing a temporary tread insert in a stair pan of a stairway framework.

It should be understood that the implementation of other variations and modifications of the disclosed apparatus and method and their various aspects will be apparent to one skilled in the art and that the disclosed subject matter is not limited by the specific embodiments described. Therefore, it is contemplated to cover the present invention and any all modifications, variations, or equivalents that fall within the true spirit and scope of the basic underlying principles disclosed and claimed herein.

What is claimed:

1. A temporary stair tread insert for temporary use and removable installation during building construction prior to a permanent concrete tread being installed in a stair pan of a stairway framework, the stair pan having a flat surface, comprising:

an insert body having an upper tread surface, a bottom surface and opposed side surfaces;

the insert body adapted to be removably inserted into the stair pan, the bottom surface of the insert body removably engaging the flat surface of the stair pan when the insert body is inserted into the stair pan;

a front end of the insert body having a curved surface;

the insert body having a notched surface extending along the front end of the insert body upper tread surface.

2. The temporary tread insert of claim 1, wherein:
the upper tread surface includes a non-skid surface configuration.

3. The temporary tread insert of claim 2, wherein:
said non-skid surface configuration is applied to a portion of the upper tread surface.

4. The temporary tread insert of claim 1, wherein:
the insert body comprises a curved rear end extending between the upper tread surface and the bottom surface, the curved rear end directed downwardly and away from the upper tread surface, and directed toward the front end of the insert body, the curved rear end of the insert body adapted to avoid contact with an offset angled stair riser when the insert body is inserted into and removed from the stair pan.

5. The temporary tread insert of claim 1, wherein:
the insert body has a rear end,
an aperture disposed adjacent the rear end of the insert body, said aperture adapted to receive an instrumentality under the control of a user to manually manipulate movement of the insert body relative to the stair pan riser.

6. The temporary tread insert of claim 5, wherein said aperture has an elongated shape.

7. The temporary tread insert of claim 1 wherein:
at least one magnet is mounted on the bottom surface of the insert body.

8. The temporary tread insert of claim 7 wherein:
the bottom surface of the insert body includes at least one recessed portion,
the at least one magnet mounted in the recessed portion.

9. The temporary tread insert of claim 1, wherein,
said upper tread surface extends in a first plane, and
said notched surface extends in a second plane,
said second plane at a predetermined distance below said first plane.

* * * * *